US005768947A

United States Patent [19]

Fee et al.

[11] Patent Number: 5,768,947

[45] Date of Patent: Jun. 23, 1998

[54] IMPLEMENT HAND SUPPORT AND CONTROL

[75] Inventors: David M. Fee, Groveland; Stephen A. Haytcher, Peoria, both of Ill.

[73] Assignee: Caterpillar Inc., Peoria, Ill.

[21] Appl. No.: 670,736

[22] Filed: Jun. 24, 1996

[51] Int. Cl.[6] ..... G05G 1/24

[52] U.S. Cl. ..... 74/523; 74/543; 74/491

[58] Field of Search ..... 74/523, 543, 491; 172/431, 75; 180/334, 335, 336

[56] References Cited

U.S. PATENT DOCUMENTS

| | | | |
|---|---|---|---|
| 2,323,859 | 7/1943 | Wheatley | 74/491 |
| 2,787,746 | 4/1957 | Redmond | 74/491 X |
| 3,941,009 | 3/1976 | Brown | 74/543 X |
| 4,332,177 | 6/1982 | Andresen | 74/523 X |
| 4,385,353 | 5/1983 | Schneider | 364/424 |
| 4,574,651 | 3/1986 | Nordstrom | 74/523 X |
| 5,244,066 | 9/1993 | Mackoway et al. | 192/13 |
| 5,462,125 | 10/1995 | Stratton et al. | 172/826 |
| 5,533,590 | 7/1996 | Steffen et al. | 74/523 X |

*Primary Examiner*—Charles A. Marmor
*Assistant Examiner*—Mary Ann Battista
*Attorney, Agent, or Firm*—Paul J. Maginot

[57] ABSTRACT

An implement control system for use with an article of construction machinery includes an implement adapted for mounting to an article of construction equipment, the implement including first and second ranges of motion, a hand support adapted for mounting to the article of construction equipment in the vicinity of an operator, the hand support including a base, an end portion upstanding at a first angle from the base and a hand grip extending outwardly from the end portion, the hand grip defining a distal end thereof and an opening between the hand grip and the base adapted for permitting an operator's fingers to extend therebetween in order to grip the hand grip, a first control lever movably mounted to the distal end of the hand grip, the first control lever being operably connected to the implement for controlling the first range of motion and adapted for movement thereof by an operator's thumb, a second control lever movably mounted to the base, the second control level being operably connected to the implement for controlling the second range of motion and adapted for movement thereof by an operator's fingers.

7 Claims, 3 Drawing Sheets

IMPLEMENT HAND SUPPORT AND CONTROL

TECHNICAL FIELD

The present invention relates generally to a hand control for use in the operator cab of an article of construction equipment and, more particularly, to a hand control which serves both as a grip for supporting the operator while operating the article of construction equipment and as an implement control for operating an implement of the article of construction equipment.

BACKGROUND ART

Various hand controls are known which are adapted for operating construction equipment in rough terrain. Such hand controls desirably stabilize movement of the hand of the operator while permitting the operator to actuate various switches and levers.

For example, in U.S. Pat. No. 5,244,066 a control console assembly is provided having a hand rest adapted to receive the hand of an operator such that the heel of the operator's hand remains in intimate contact with a raised portion of the hand rest. The various controls for the operating function of the earthworking vehicle are controlled by the fingers of the operator without having to move the heel of his hand from the raised portion of the hand rest. This allows the operator to have a more finite and smooth control of the various operating functions of the construction equipment even though his body is being jostled around due to the earthworking vehicle traversing rough terrain.

Although the control console assembly in U.S. Pat. No. 5,244,066 meets and exceeds the demands of the operating functions for which it was designed to control, there is nevertheless a need for a hand control which, in addition to stabilizing movement of the hand of the operator while permitting the operator to actuate various switches and levers, also serves as a hand grip for supporting the operator's body during machine operation. Such a hand control is preferably adapted for use with the implement controls of the construction equipment.

DISCLOSURE OF THE INVENTION

According to one embodiment of the present invention, an implement control system for use with an article of construction machinery is disclosed, the implement control system comprising an implement adapted for mounting to an article of construction equipment, the implement including first and second ranges of motion, a hand support adapted for mounting to the article of construction equipment in the vicinity of an operator, the hand support including a base, an end portion upstanding at a first angle from the base and a hand grip extending outwardly from the end portion, the hand grip defining a distal end thereof and an opening between the hand grip and the base adapted for permitting an operator's fingers to extend therebetween in order to grip the hand grip, a first control lever movably mounted to the distal end of the hand grip, the first control lever being operably connected to the implement for controlling the first range of motion and adapted for movement thereof by an operator's thumb, a second control lever movably mounted to the base, the second control lever being operably connected to the implement for controlling the second range of motion and adapted for movement thereof by an operator's fingers.

According to another embodiment of the present invention, a control system for use with an article of construction machinery is disclosed, the control system comprising a first hand support adapted for mounting to an article of construction equipment at one side of an operator, the first hand support including a first control lever adapted for movement thereof by an operator's thumb and a second control level adapted for movement thereof by an operator's fingers, a second hand support adapted for mounting to the article of construction equipment at the other side of the operator, the second hand support including a base, an end portion upstanding at a first angle from the base and a hand grip extending outwardly from the end portion, the hand grip defining a distal end thereof and an opening between the hand grip and the base adapted for permitting an operator's fingers to extend therebetween in order to grip the hand grip, the second fixed hand support including a third control lever adapted for movement thereof by an operator's thumb and a fourth control lever adapted for movement thereof by an operator's fingers.

According to another embodiment of the present invention, a method for controlling an implement of an article of construction machinery is disclosed, the implement including first and second ranges of motion, the article including a hand support having a base, an end portion upstanding at a first angle from the base and a hand grip extending outwardly from the end portion, the hand grip defining a distal end thereof and an opening between the hand grip and the base, a first control lever movably mounted to the distal end of the hand grip and operably connected to the implement for controlling the first range of motion, and a second control lever movably mounted to the base and operably connected to the implement for controlling the second range of motion, the method comprising the steps of (a) gripping the handgrip with a hand of an operator such that the fingers of the hand extend through the opening to grip the handgrip and thereby support the operator, (b) moving the first control lever with the thumb of the hand and thereby moving the implement within the first range of motion, and (c) moving the second control lever with the fingers of the hand and thereby moving the implement within the second range of motion.

BEST MODE FOR CARRYING OUT THE INVENTION

Figure 1:
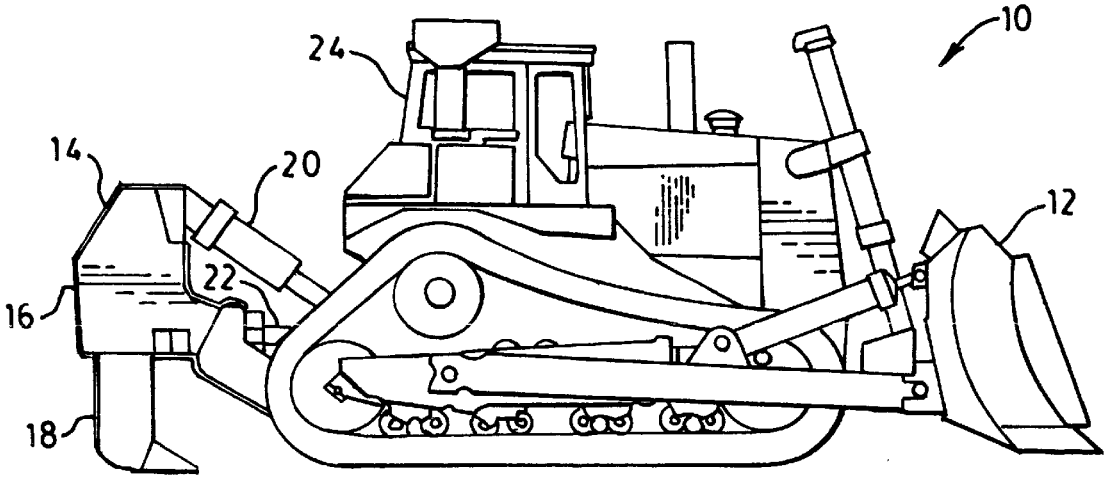
FIG. 1 is a side elevational view of a track-type tractor according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, an article of construction equipment 10 is disclosed which, in the preferred embodiment, is a track-type tractor including implements in the form of a blade 12 and ripper 14. As is known in the art, ripper 14 is utilized at the back portion of tractor 10 to break up soil and rocks of the underlying earth. Ripper 14 includes a movable frame 16 and movable ripper teeth 18, both of which are hydraulically operable via cylinders 20 and 22, respectively, from the operator's station 24. Ripper frame 16 is movable in a vertical direction or generally normal to the underlying earth to control the depth of cut of the ripping operation. Similarly, ripper teeth 18 are movable fore and aft or generally parallel with the underlying earth to control the angle of cut of the ripping operation. Blade 12 is also generally movable in vertical and horizontal directions, it being understood that such vertical and horizontal directions include rotation about corresponding horizontal and vertical axes.

Figure 2:
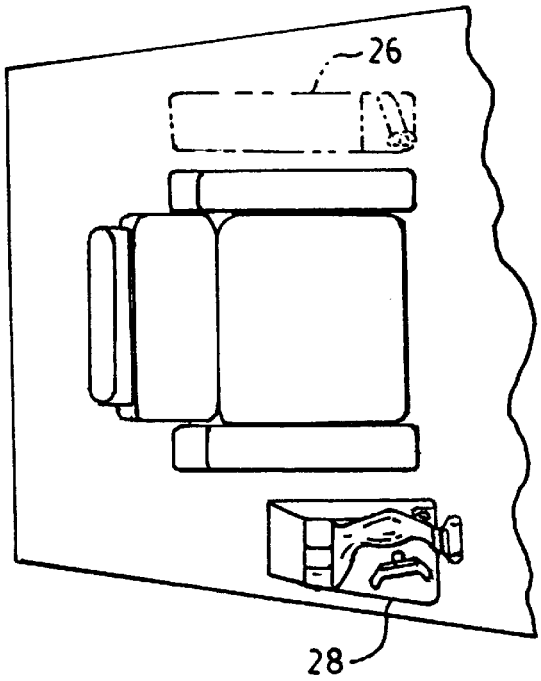
FIG. 2 is a top plan view of the operator cab of the embodiment of FIG. 1.

Referring now to FIG. 2, the operator station 24 is shown. When seated, the tractor's speed and direction is controlled at the left side of the operator by control console assembly 26. The implement operation is controlled at the right side of the operator by implement hand support and control 28.

The construction and operation of control console assembly 26 is further detailed in U.S. Pat. No. 5,244,066, the contents of which are hereby incorporated by reference. As described in U.S. Pat. No. 5,244,066, control console assembly 26 includes a pair of levers mounted adjacent to a hand rest and operatively actuated by the fingertips of the operator's hand. A rotary knob is oriented on the side of the hand rest and operative to be rotated by the thumb of the operator's hand. The heel of the operator's hand rests on a hand rest such that the heel of the operator's hand remains in intimate contact with a raised portion of the hand rest. As such, the operator's hand is supported relative to tractor 10 so that the operator's thumb and fingertips have a more finite and smooth control of the various operating functions of the construction equipment.

Prior art implement controls have included a joystick operable along two axes corresponding to the axes of the implement operation. However, as the operator is jostled during implement operation, unintentional actuation of the implement can result. Also, it is ergonomically desirable for the operator to be able to support himself. As such, it is desirable for the operator to be able to support himself with the same hand that operates the ripper control during operation of the ripper.

Figure 3:
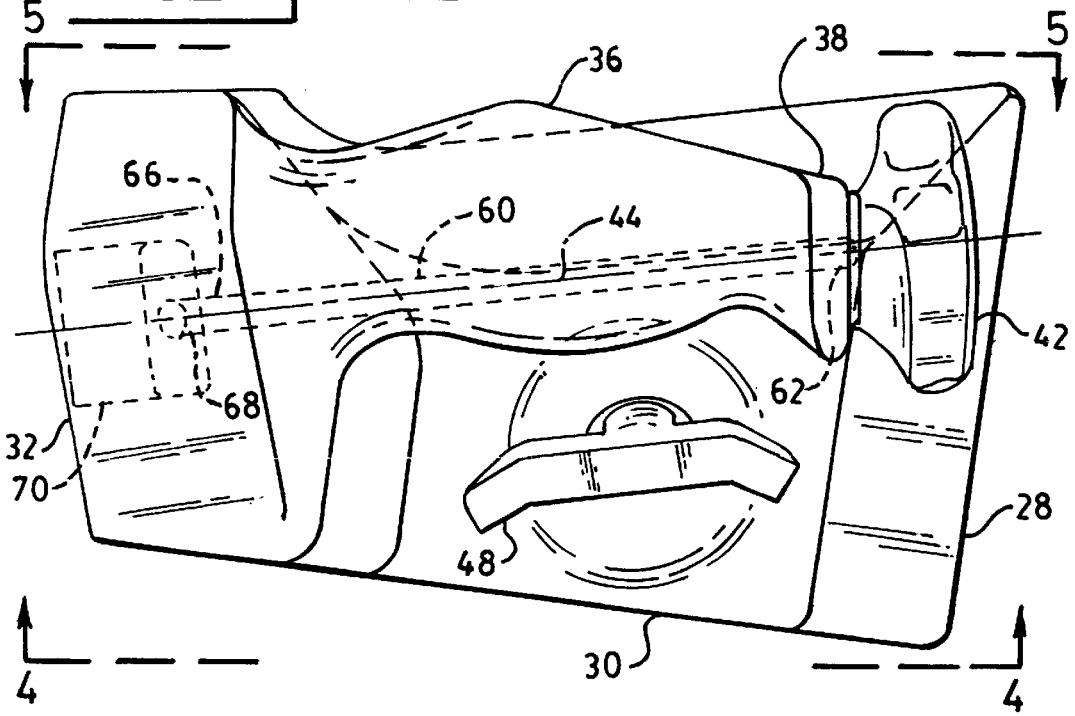
FIG. 3 is a top plan view of a hand control mounted in the cab of FIG. 2.
Figure 4:
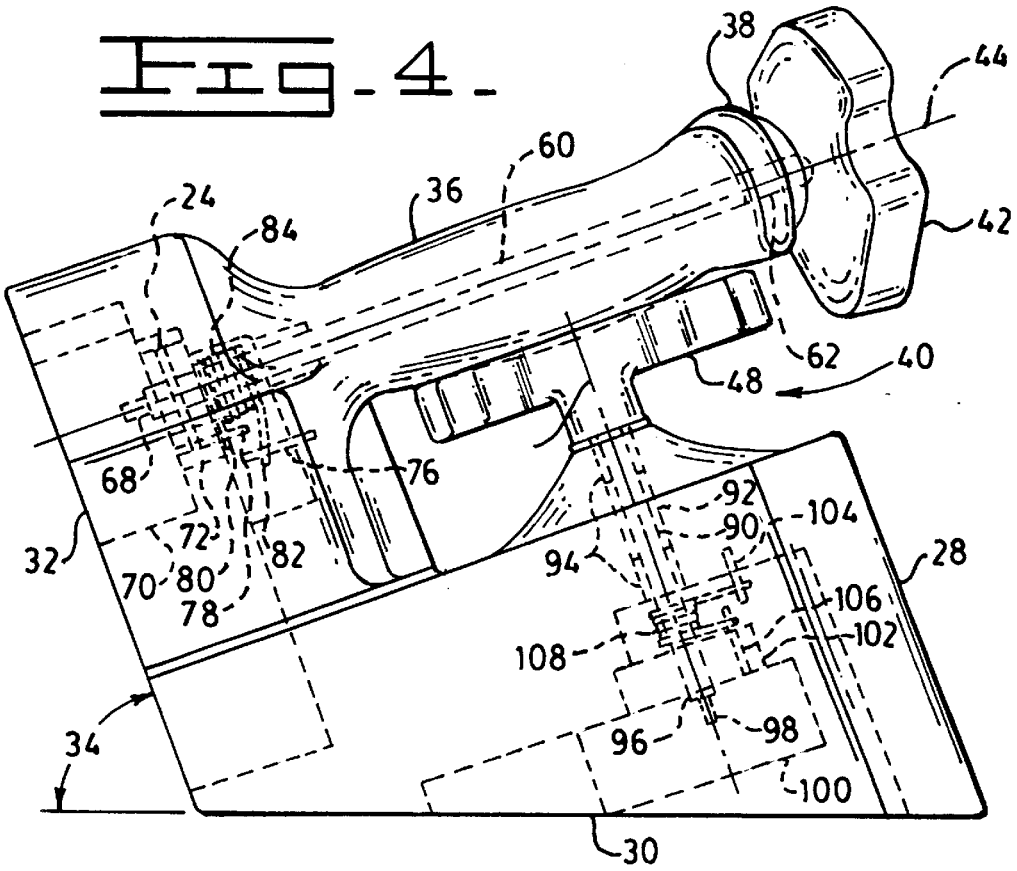
FIG. 4 is a first side elevational view of the hand control of FIG. 3 taken along line 4–4 in the direction of the arrows indicated.
Figure 5:
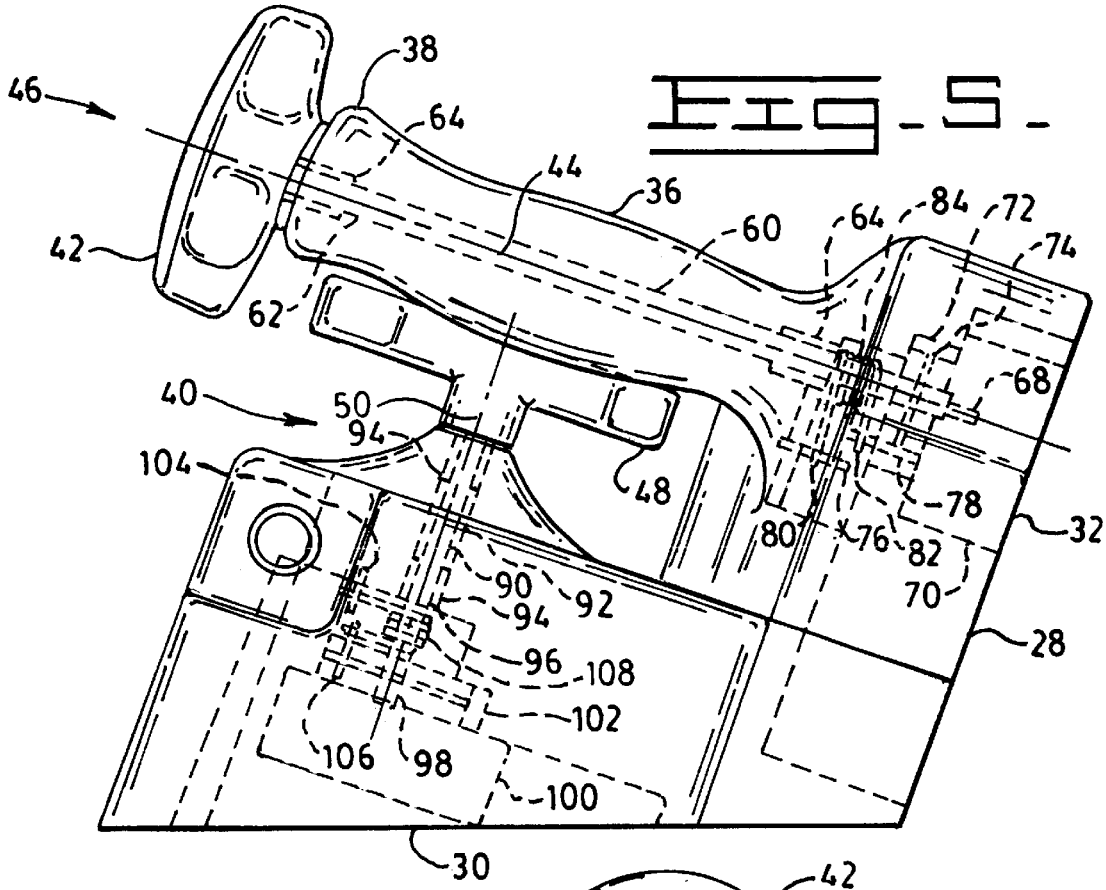
FIG. 5 is a second side elevational view of the hand control of FIG. 3.
Figure 6:
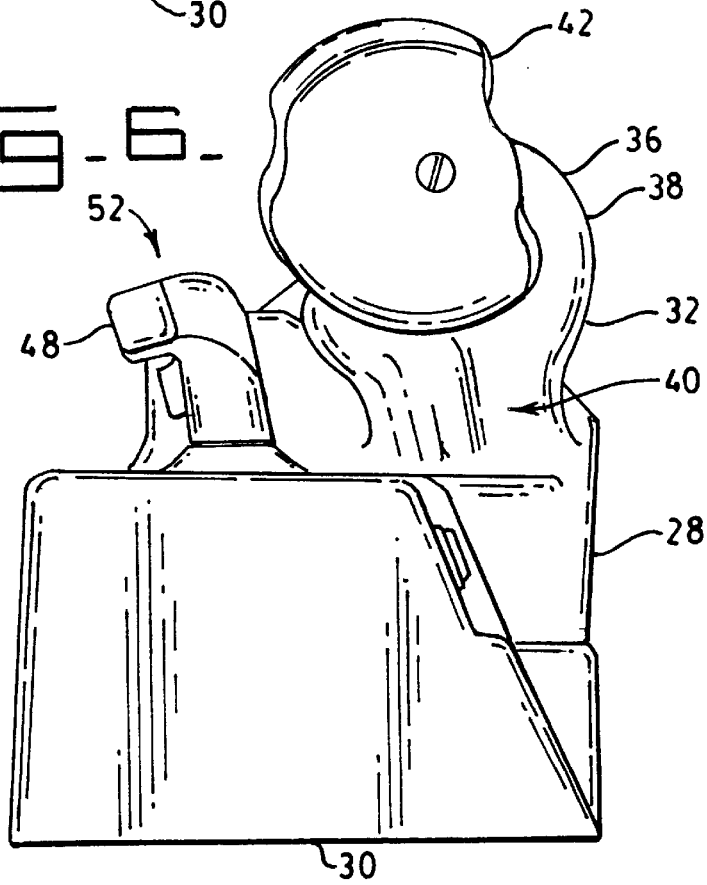
FIG. 6 is an end view of the hand control of FIG. 3.

Referring now to FIGS. 3–5, hand support and control 28 provides such support and control by providing a fixed hand grip in conjunction with the implement controls. In the specific preferred embodiment shown, hand support and control 28 controls the ripper operation and includes a base 30, an end portion 32 upstanding at a first angle 34 from base 30, and a hand grip 36 extending outwardly from end portion 32 so as to define a distal end 38 of the hand grip 36 and an opening 40 for finger clearance between hand grip 36 and base 30. Because hand grip 36 is fixed relative to tractor 10 and includes finger clearance sufficient for the operator to wrap his fingers around the grip, the operator can securely position himself using his right hand wrapped around grip 36, while adjusting speed and direction with his left hand resting on control console assembly 26. While maintaining this grip, the operator can further operate the ripper controls as described hereinafter.

A first control lever 42 is rotationally mounted to distal end 38 of hand grip 36 and defines a first axis of rotation 44. Control lever 42 controls vertical movement of ripper 14 via rotation about axis 44. Rotation of lever 42 is most readily accomplished by the operator's thumb. As viewed in the direction of arrow 46, clockwise rotation of lever 42 moves ripper 14 upward, and counterclockwise rotation of lever 14 moves ripper 14 downward.

A second control lever 48 is rotationally mounted to base 30 and defines a second axis of rotation 50. Control lever 48 controls fore and aft movement of ripper teeth 18 via rotation about axis 50. Rotation of lever 48 is most readily accomplished by the operator's fingers.

In the specific preferred embodiment shown, axis 44 is normal to or perpendicular to axis 50.

Both levers 42 and 48 are biased towards a non-actuating neutral position in which the ripper frame and teeth positions are maintained. For example, to set the ripper in a desired down position with its teeth angled inward a desired degree, the operator rotates levers 42 and 48 counterclockwise. Once the desired ripper position is achieved, the operator releases both levers which, under bias, return to their non-actuating neutral position thereby maintaining the desired ripper position.

Lever 42 is mounted to a shaft 60 received in a bore 62 of grip 32. Shaft 60 extends the full length of grip 32 and is simply supported therein against non-metallic bearings 64. The distal end 66 of shaft 60 includes a keyed portion 68 adapted for receipt indexed within a correspondingly keyed rotary position sensor 70. Distal end 66 of shaft 60 is received through and attached within a lobed member 72 by a retaining pin 74. A first pin 76 extending from end portion 32 and a second pin 78 extending from lobed member 72 are received between overlapping ends 80,82 of a spring 84 disposed about shaft 60. As shaft 60 is rotated clockwise from its neutral position, second pin 78 rotates end 80 of spring 84 while end 82 is held in place by first pin 78. Conversely, as shaft 60 is rotated counterclockwise from its neutral position, first pin 76 rotates end 82 of spring 84 while end 80 is held in place by first pin 78.

In a similar fashion, lever 48 is mounted to a shaft 90 received in a bore 92 of base 30. Shaft 90 is similarly supported by non-metallic bearings 94 and includes at its distal end 96 a keyed portion 98 adapted for receipt indexed within a correspondingly keyed rotary position sensor 100. Distal end 96 of shaft 90 is similarly attached within a lobed member 102, and first and second pins 104,106 similarly cooperate with spring 108 to bias lever 48 toward its neutral position.

Rotary position sensors 70 and 100 are position sensors of Caterpillar design which mount within recesses of base 30 and receive keyed portions 68 and 98, respectively. In the specific preferred embodiment shown, these position sensors are Caterpillar P/N 134-6067 available from Caterpillar's parts facility at 120 Detroit Pkwy, Morton, Ill., 61550-1857 and described in corresponding Caterpillar literature available under such part number, the contents of which are hereby incorporated by reference. Each of sensors 70 and 100 sense rotational shaft position and produce an electronic position signal corresponding to shaft position. An electronic controller receives the position signal and controls the implement hydraulic control valving in response to the position signal. The controller is contemplated as controlling the implement hydraulic control valving linearly as a function of shaft position as well as non-linearly as a function of both shaft position as well as degree of change in shaft position (small degrees of change in shaft movement yielding slow rates of speed of implement operation—large degrees of change in shaft movement yielding fast rates of speed of implement operation).

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

what is claimed is:

1. An implement control system for use with an article of construction equipment, the implement control system comprising:

an implement adapted for mounting to the article of construction equipment, said implement including first and second ranges of motion;

a hand support adapted for mounting to the article of construction equipment in the vicinity of an operator;

said hand support including a base, an end portion upstanding at a first angle from said base and a hand grip extending outwardly from said end portion;

said hand grip defining a distal end thereof and an opening between said hand grip and said base adapted for permitting the operator's fingers to extend therebetween in order to grip said hand grip;

a first control lever movably mounted to said distal end of said hand grip, said first control lever being operably connected to said implement for controlling said first range of motion and adapted for movement thereof by the operator's thumb;

a second control lever movably mounted to said base, said second control lever being operably connected to said implement for controlling said second range of motion and adapted for movement thereof by the operator's fingers.

2. The implement control system of claim 1, wherein said first angle is in the range of 15 to 25 degrees relative to said base.

3. The implement control system of claim 1, wherein said implement is a ripper including a frame movable through said first range of motion and ripper teeth movable through said second range of motion.

4. The implement control system of claim 1, wherein said first control lever is rotatably mounted to said distal end of said hand grip and defines a first axis of rotation, said first control lever being adapted for rotation thereof by the operator's thumb.

5. The implement control system of claim 4, wherein said second control lever is rotatably mounted to said base and defines a second axis of rotation, said second control lever being adapted for rotation thereof by the operator's fingers.

6. The implement control system of claim 5, wherein said second axis of rotation is perpendicular to said first axis of rotation.

7. A method for controlling an implement of an article of construction machinery, said implement including first and second ranges of motion, said article including a hand support having a base, an end portion upstanding at a first angle from said base and a hand grip extending outwardly from said end portion, said hand grip defining a distal end thereof and an opening between said hand grip and said base, a first control lever movably mounted to said distal end of said hand grip and operably connected to said implement for controlling said first range of motion, and a second control lever movably mounted to said base and operably connected to said implement for controlling said second range of motion, said method comprising the steps of:

gripping the handgrip with a hand of an operator such that the fingers of the hand extend through said opening to grip the handgrip and thereby support the operator;

moving the first control lever with the thumb of the hand and thereby moving the implement within said first range of motion; and moving the second control lever with the fingers of the hand and thereby moving the implement within the second range of motion.

* * * * *